United States Patent [19]

Cummings, III et al.

[11] Patent Number: 5,063,486

[45] Date of Patent: Nov. 5, 1991

[54] MOUNTING APPARATUS FOR A FLUORESCENT LAMP HOLDER

[75] Inventors: Thomas L. Cummings, III, Nashville; Ned S. Al-Orfali, Murfreesboro, both of Tenn.

[73] Assignee: Cummings Incorporated, The International Sign Service, Nashville, Tenn.

[21] Appl. No.: 604,100

[22] Filed: Oct. 29, 1990

[51] Int. Cl.[5] ..... F21S 3/00

[52] U.S. Cl. ..... 362/217; 362/812; 40/564; 439/237

[58] Field of Search ..... 362/217, 812; 40/564, 40/568, 569, 572, 574, 575; 439/226, 237, 243, 244

[56] References Cited

U.S. PATENT DOCUMENTS

| | | | |
|---|---|---|---|
| 3,116,098 | 12/1963 | Kulka | 439/237 |
| 3,287,688 | 11/1966 | Laurenzo | 439/237 |
| 3,327,281 | 6/1967 | Johnson | 439/237 |
| 3,426,312 | 2/1969 | Gerald | 439/237 |
| 3,685,003 | 8/1972 | Watt | 439/237 |
| 4,070,779 | 1/1978 | Gilmour | 40/575 |

*Primary Examiner*—Stephen F. Husar
*Assistant Examiner*—Richard R. Cole
*Attorney, Agent, or Firm*—Harrington A. Lackey

[57] ABSTRACT

A mounting apparatus for fluorescent lamp holders in a fluorescent sign frame including a stationary and a compressible lamp holder for each lamp detachably connectable to an attachment bracket having a forward projecting pair of parallel latch tongues adapted to snap-fasten into a pair of corresponding slots in a mounting plate or raceway cover from the rear of the raceway cover.

11 Claims, 2 Drawing Sheets

MOUNTING APPARATUS FOR A FLUORESCENT LAMP HOLDER

BACKGROUND OF THE INVENTION

This invention relates to a mounting apparatus for a fluorescent lamp holder, and more particularly to an apparatus in which each of the stationary and compressible lamp holders may be detachably mounted to its corresponding raceway cover from the rear of the raceway cover in order to facilitate mounting of the lamp holders.

Heretofore, in the assembly of lamp holders in an illuminated or fluorescent sign frame, it has been the custom to mount the corresponding lamp holders upon their corresponding raceway covers by attaching or detachably connecting each of the lamp holders through the front of the lamp holder. Such mounting of the lamp holders from the front, or from the inside of the sign through the corresponding raceway covers, requires that the wiring be completed only after each lamp holder is attached to its corresponding raceway cover. Such assembly of the wire and connection of the wiring requires an undue amount of time.

One example of such a prior fluorescent lamp holder which must be inserted from the front or the inside of the corresponding raceway cover or bracket is illustrated in the Kulka U.S. Pat. No. 3,116,098, issued Dec. 31, 1963. Because of the large head portion of the lamp holder, such as the lamp holder 30 or 40 in the Kulka U.S. Pat. No. 3,116,098, the lamp holder must be inserted from front-to-rear through the corresponding mounting opening 34 in the mounting brackets 26 and 28. In this case, the wire can be pre-assembled to the lamp holder 40 but the length of whatever wire is assembled to the lamp holder 40 must be threaded from front to rear through the corresponding mounting opening 34. The length of the wire attached to the lamp holder could be short initially in order to insert the wire and the corresponding lamp holder through the mounting opening 34 from front-to-rear. However, the remainder of the wiring harness must be spliced to the lamp holder after the lamp holder 40 is secured in place on its corresponding bracket. It will thus be seen that in view of the numerous lamps, this cutting and re-splicing of wire must be repeated at least twice for each lamp utilized.

Another example of the prior assembly of a compressible lamp holder in its mounting plate or raceway cover, is disclosed in U.S. Pat. No. 3,681,593, issued on Aug. 1, 1972, to John M. Genovese et al, entitled SNAP-IN FLUORESCENT LAMP HOLDER WITH FRONT END RELEASE.

Examples of a general use of channel-shaped or U-shaped brackets for use in mounting or supporting electrical equipment are disclosed in the following two U.S. Pat. Nos.:

| | | |
|---|---|---|
| 2,915,272 | Sislik | Dec. 1, 1959 |
| 4,669,803 | Kim | June 2, 1987 |

The Sislik mounting bracket is used for mounting or supporting a rectifier 10, while the mounting bracket or terminal disclosed in the Kim patent is used with an antennae feeder-connecting terminal for a television set.

In both Sislik and Kim, it should be particularly noted that the ears or latch tongues formed on the free legs of the channel-shaped bracket are bent or folded away from the legs and away from each other, so that the free end portions or latching portions although engaging the opposite side of the main mounting plate, nevertheless, extend outwardly so that they function only as latches. There is no portion of the latch tongues which extends inwardly toward each other to assist in covering the back surface of the mounting plate or to close the passage through the corresponding latch tongue holes.

Other U.S. patents disclosing various types of fluorescent lamp holders and fluorescent lamp signs are listed below:

| | | |
|---|---|---|
| 3,327,281 | Johnson | June 20, 1967 |
| 3,390,259 | Angier | June 25, 1968 |
| 3,391,481 | Lloyd | July 9, 1968 |
| 3,742,633 | Palm | July 3, 1973 |
| 4,070,779 | Gilmour | Jan. 31, 1978 |
| 4,265,039 | Brooks | May 5, 1981 |
| 4,267,657 | Kloke | May 19, 1981 |
| 4,287,555 | Stilling | Sep. 1, 1981 |
| 4,317,302 | Von De Linde | Mar. 2, 1982 |
| 4,504,891 | Mazis | Mar. 12, 1985 |
| 4,553,345 | Bercier et al | Nov. 19, 1985 |
| 4,817,317 | Kovalak, Jr. | Apr. 4, 1989 |

SUMMARY OF THE INVENTION

It is therefore an object of this invention to provide a mounting apparatus for a plurality of fluorescent lamp holders, particularly in a fluorescent sign frame, in which the lamp holders may be easily and quickly assembled, and even detachably fastened to the existing raceway covers with a minimum of disruption to the wiring harness for feeding electricity to the fluorescent lamp holders.

It is another object of this invention to provide a mounting apparatus for a plurality of fluorescent lamp holders in which all of the wiring harness to each of the lamp holders may be pre-assembled and pre-connected to the lamp holders, while still permitting each of the lamp holders to be quickly and securely latched to its corresponding mounting plate or raceway cover, while threading each of the lamp holders from the rear of the raceway cover through corresponding large holes in the raceway covers, without disruption or interruption of the wiring.

A further object of this invention is to provide a mounting apparatus for a fluorescent lamp holder in which a special attachment bracket is utilized for quickly snap-fastening the lamp holder to the attachment bracket after all the wire harness has been prewired, to provide a pre-assembled unit which may be easily thrust forward through the corresponding raceway cover and snap-fastened into position and to provide a unique snap-fastening construction which would aid in the minimization of penetration of dust or moisture through the corresponding raceway cover.

DESCRIPTION OF THE PREFERRED EMBODIMENT

Figures 1, 2, 3:
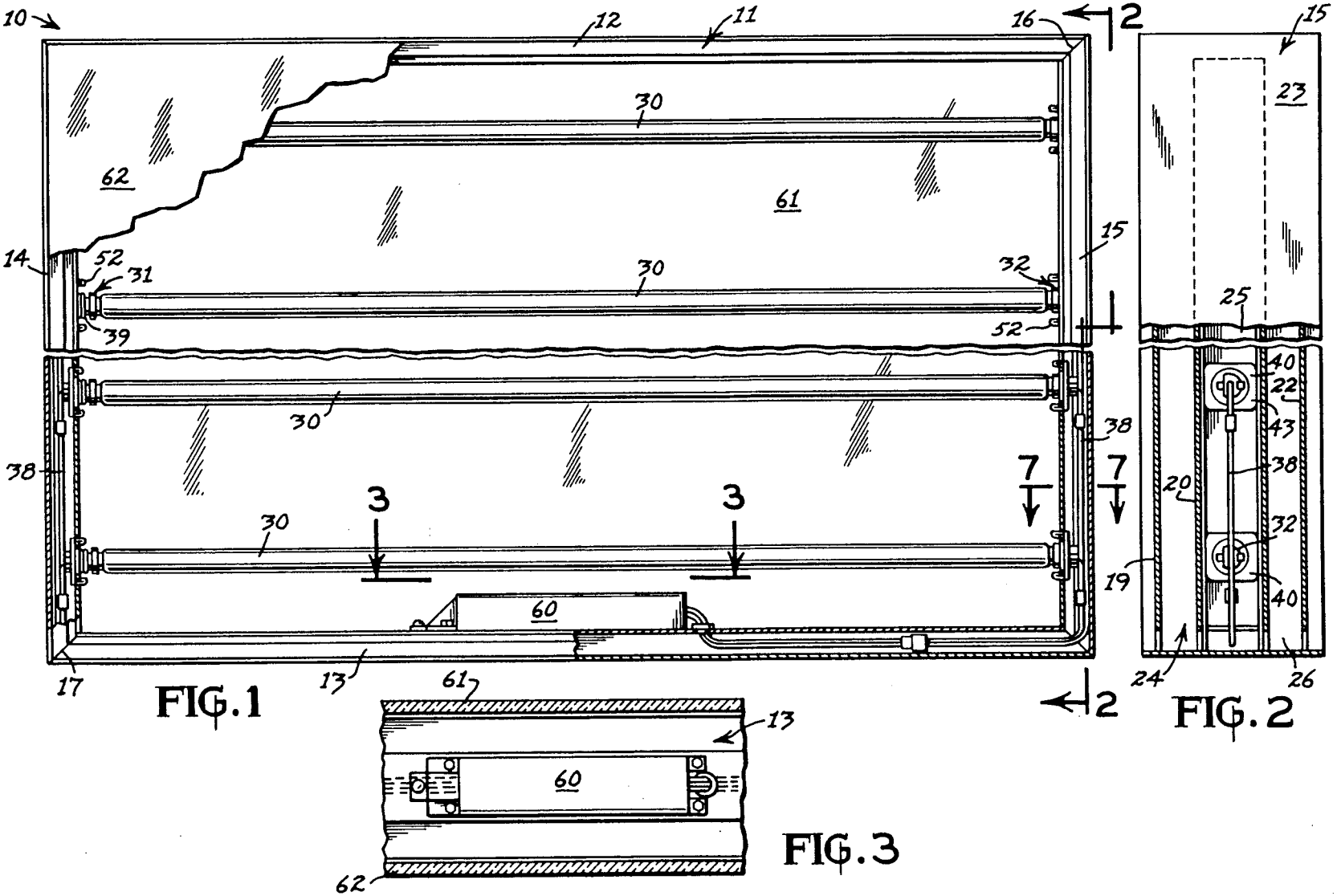
FIG. 1 is a front elevation of a fluorescent sign, with portions broken away.
FIG. 2 is a section taken along the line 2—2 of FIG. 1.
FIG. 3 is a fragmentary top plan view taken along the line 3—3 of FIG. 1.

Referring now to the drawings in more detail, FIG. 1 discloses an illuminated sign 10 including a rectangular sign frame 11 having an elongated horizontal top frame member 12, an elongated horizontal bottom frame member 13, and a pair of opposite side frame members 14 and 15.

The opposite ends of the top frame member 12 are secured to the top ends of the opposite side frame members 14 and 15 by any convenient means and preferably formed as miter joints 16.

In a like manner, the opposite ends of the bottom frame member 13 are secured in any desired manner to the bottom ends of the opposite side frame members 14 and 15, also to preferably form miter joints 17.

Figure 4:
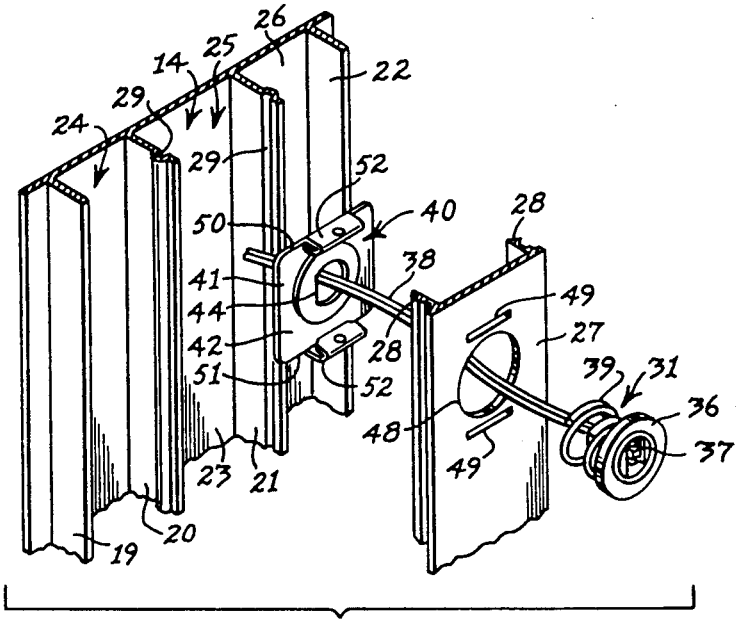
FIG. 4 is an inside, fragmentary perspective view of a portion of a side frame member of a fluorescent sign illustrating the assembly of a compressible lamp holder upon the mounting apparatus made in accordance with this invention.
Figure 7:
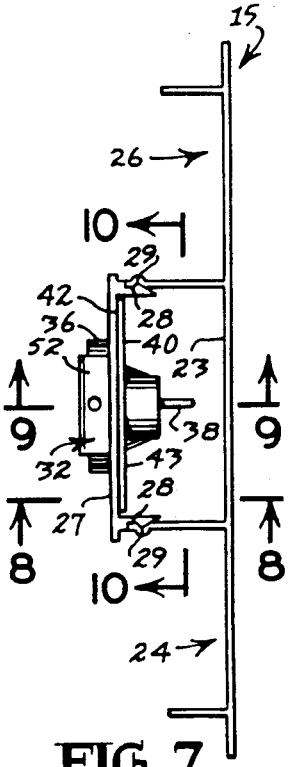
FIG. 7 is an enlarged fragmentary section taken along the line 7—7 of FIG. 1, illustrating the stationary lamp holder secured upon its mounting apparatus, but with the lamp removed.

Each of the top and bottom frame members 12 and 13 and the opposite side frame members 14 and 15 are preferably extruded to have the same channel shape, as disclosed in FIGS. 4 and 7. For example, in FIG. 4, the channel-shaped side frame member 14 includes four elongated parallel channel walls 19, 20, 21, and 22, projecting inward from an elongated vertical side plate 23 to define an elongated vertical front channel 24, an intermediate or interior elongated vertical channel 25 and an elongated vertical rear channel 26.

The inner opening of each of the interior channels 25 is covered by an elongated mounting plate or raceway cover 27. Projecting from the rear or outside surface, that is the surface opposing the interior channel 25, of each raceway cover 27 are a pair of vertical parallel elongated hook-shaped detents 28 for snap-fastening into a latched position with corresponding opposed vertical elongated grooves 29 formed in the opposed surfaces of the inside channel walls 20 and 21. Thus, by moving the raceway cover 27 toward the opening defined by the channel walls 20 and 21 and inserting the hook-shaped detents 28 to move outward along the channel walls 20 and 21, the hook-shaped detents 28 will eventually snap into the grooves 29, in order to firmly secure the raceway cover 27 into the open side of the channel 25, and to thereby close the channel 25, as best disclosed in FIGS. 4 and 7.

Mounted within the sign 10 are a plurality of vertically spaced elongated, parallel, fluorescent lamps 30, as disclosed in FIG. 1.

Each end of each lamp 30 is provided, in a conventional manner, with electrical contacts, not shown, which are adapted to electrically engage and be received in a corresponding lamp holder, such as the compressible lamp holder 31 or a stationary lamp holder 32. In FIG. 1, the compressible lamp holders 31 are shown mounted along the left side of the side frame member 14 and adapted to be mounted and received within the left raceway cover 27. All of the stationary lamp holders 32 are illustrated in FIG. 1 as being mounted along the right side frame member 15 and are adapted to be mounted and received within the right raceway cover 27. The right raceway cover 27 is of identical construction to the left raceway cover 27, and is mounted within the central channel 25 of the right side frame member 15 in the same manner as the left raceway cover 27 is mounted in the central channel 25 of the left side frame member 14.

The compressible lamp holder 31 and the stationary lamp holder 32 are of conventional construction, each of which includes a substantially cylindrical body portion 34, one side of which is cut away to have a planar surface 35 so that the cross-section of each body portion 34 is roughly a D-shape. The front end or inner end of each body portion 34 terminates in an enlarged head or disk 36, which is preferably cylindrical, each head 36 being provided with a central socket 37 for receiving the contact end of the corresponding lamp 30, in a conventional manner. Projecting rearwardly from the rear end of the body portion 34 and in electrical contact with the socket 37 are one or more electrical conductor wires 38. The above-described structure is essentially the structure of a conventional stationary lamp holder 32 as found on the right side of the sign frame 11.

The main difference between the stationary lamp holder 32 and the compressible lamp holder 31 is that a coil spring 39 is coiled about the body portion 34 between the head 36 and a fixed part of the mounting apparatus, to be described, so that the lamp holder 31 may be manually depressed by compressing the spring in order to facilitate mounting of the left contact ends of the lamp 30 upon the mounting plate 27. As previously mentioned, a compressible lamp holder 31 and a stationary lamp holder 32 at the opposite end of the same lamp 30 are well known structures to facilitate the mounting of the lamp 30 within the sign frame 11.

The mounting apparatus made in accordance with this invention includes an attachment bracket 40 of novel construction and certain modifications in the mounting plate or raceway cover 27.

The attachment bracket 40 will be identical for both a compressible lamp holder 31 and a stationary lamp holder 32.

The attachment bracket 40 made in accordance with this invention includes a plate member 41 having a front or inner surface 42 and a rear or outer surface 43. As disclosed in the drawings, the plate member 41 may be substantially square.

Formed in the center of the attachment plate member 41 is an attachment hole 44 having a substantially D-shaped cross-section and being of substantially the same size, or just slightly larger than the cross-section of the body portion 34 of either lamp holder 31 or 32. Thus, the purpose of the attachment hole 44 is to axially register with and receive the body portion 34 of either lamp holder 31 or 32, without any relative rotary movement between the lamp holder 31 or 32 and the attachment bracket 40.

Moreover, the attachment hole 44 is of a size less than the cross-sectional shape of the lamp holder head 36, to prevent the passage of the head 36 through the attachment hole 44.

Figure 9:
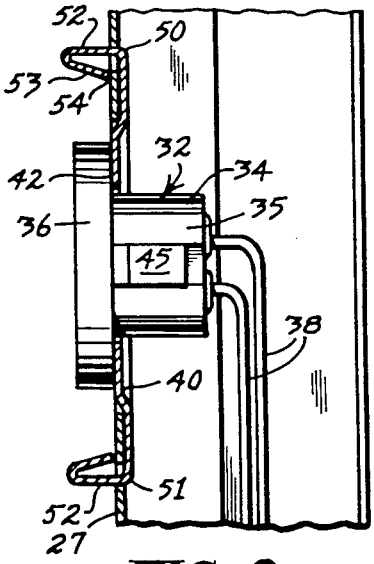
FIG. 9 is a substantially enlarged fragmentary section taken along the line 9—9 of FIG. 7, with the lamp removed.
Figure 8:
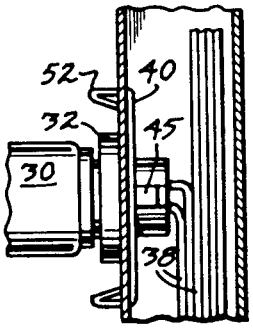
FIG. 8 is a fragmentary section taken along the line 8—8 of FIG. 7 with the right end of the lamp fragmentarily illustrated.

In a conventional manner, a pair of spring clips or detents 45 are mounted on opposite sides of the body portion 34 of each lamp holder so that they are normally biased outward beyond the periphery of the body portion 34. One of the spring clips 45 is mounted upon the flat or planar surface 35 of the body portion 34, as illustrated in FIG. 9. Moreover, these spring clips 45 are conventional for lamp holders, and conventionally used on other types of mounting apparatus, such as that disclosed in the prior Kulka U.S. Pat. No. 3,116,098 (spring clips 58 and 60), or in the prior Genovese et al U.S. Pat. No. 3,681,593.

Thus, after the wires 38 are threaded through the front of the attachment hole 44 in the attachment bracket 40, the body portion 34 of the lamp holder 31 or 32 may then be lined up with the attachment hole 44 of corresponding D-shape until it is in registry with and then forced through the attachment hole 44, simultaneously biasing the spring clips 45 inward against the body portion 34 until the hooked ends of the spring clips 45 have cleared the rear surface 43 of the attachment bracket 40, at which point the spring clips 45 will spring outwardly in order to latch the corresponding lamp holder 31 or 32 against the front surface of the attachment bracket 40. The dimensions of the spring clips 45 are such that when they latch behind the rear surface 43 of the plate member 41, the head of the lamp holder 31, 32 is in flush engagement with the front surface 42 of the attachment bracket 40. Then, in order to secure the pre-assembled lamp holder 31 or 32 mounted on the attachment bracket 40 to the corresponding raceway cover or mounting plate 27, a central hole 48 is formed in the center of each raceway cover 27 for each corresponding lamp holder 31 and 32. These central holes 48 may be spaced vertically along each raceway cover 27. Each central hole 48 has a cross-sectional dimension greater than the cross-sectional dimension of the head 36 of each corresponding lamp holder. In a preferred form of the invention, the central hole 48 is circular having a diameter greater than the diameter of the circular head 36, to permit entry of the head 36 freely into and out of the central hole 48.

Mounted above and below the central hole 48 are a pair of transverse horizontal, elongated slots 49. One transverse slot 49 is mounted above the central hole 48, while the other transverse slot 49 is mounted below the central hole 48, each slot 49 having equal spacing from the center of the same central hole 48.

Projecting from each of the top edge 50 and the bottom edge 51 of the plate member 41 of the attachment bracket 40 is an elongated transverse latch tongue 52. The lengths of the latch tongues 52 are preferably equal to each other and slightly less than the length of each transverse slot 49. The structure, spacing and dimensions of the latch tongues 52 are such that when they properly register with the parallel pairs of slots 49, the latch tongues 52 may be easily inserted forward through the corresponding slots 49 until the face or front surface 42 of the plate member 41 is substantially flush against the rear surface of the raceway cover 27.

Furthermore, each latch tongue 52 is provided with a retainer member 53 connected to each corresponding latch tongue 52 from its inside surface so that when each latch tongue 52 has been fully inserted into its corresponding transverse slot 49, the retainer members 53 will engage the front surface of the corresponding raceway cover 27 to fully latch the lamp holder 31 or 32, its attachment bracket 40 and the raceway cover 27 in their fully assembled mounted position, as disclosed in the drawings, and particularly in FIGS. 1, 5, 6, 7, 8, 9, and 10.

Figure 5:
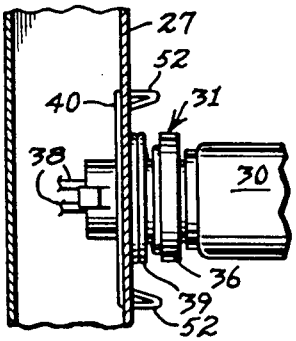
FIG. 5 is a fragmentary front elevational view of the left end of a fluorescent lamp supported in its corresponding compressible lamp holder assembled upon its mounting apparatus.
Figure 6:
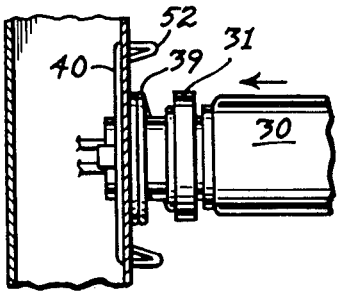
FIG. 6 is a fragmentary, front elevational view similar to FIG. 5, illustrating the insertion of the left end of the lamp into the axially movable compressible lamp holder.
Figure 10:
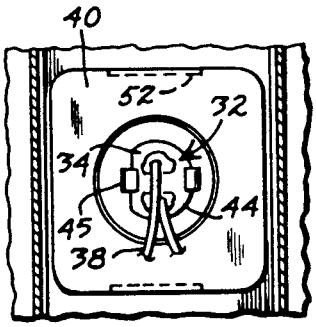
FIG. 10 is an enlarged fragmentary section taken along the line 10—10 of FIG. 7.

As best disclosed in FIG. 9, each retainer member 53 is formed as an integral part of its corresponding latch tongue 52. Thus, the front end portion of each latch tongue 52 is bent back upon the latch tongue 52, and specifically, is bent in a direction toward its attachment hole 44 to form the integral retainer member 53. The retainer member 53 then projects in the opposite rearward direction toward the front surface of the mounting plate or raceway cover 27. The retainer member 53 terminates in a free contact edge 54, which actually engages the front surface of the raceway cover 27, as illustrated in FIGS. 5, 6, and 9.

Moreover, particularly when each latch tongue 52 is integral with its retainer member 53, the material from which the latch tongue and retainer member are made, have an elasticity which will permit the retainer member or spring leg 53 to yield to the pressure of the width of each corresponding transverse slot 50 as the latch tongue 52 is forced through the slot in order to squeeze the retainer member 53 and the latch tongue 52 together. After the attachment plate member 41 has been thrust forward as far as will be permitted by the raceway cover 27, the free edge 54 will clear the raceway cover 27 and immediately spring back or inward to engage the front surface of the raceway cover 27, thereby latching the pre-assembled attachment bracket 40 and its lamp holder 31 and 32 in the central hole 48 of the corresponding raceway cover 27.

It is evident from viewing the prior Kulka and Genovese et al patents that the lamp holders have to be inserted from the front of the mounting plate or raceway cover, and cannot be inserted from the rear. Because the lamp holders must be inserted from the front, the wires must be kept severed until the lamp holders have been securely mounted in their mounting plates. Only then can the wires be joined, connected or spliced in order to connect the lamp holders to the source of electrical energy. Such a procedure for mounting lamp holders involves a considerable amount of time and labor, since considerable time must be utilized in connecting or splicing the wires for each lamp holder to the source of electrical power. Moreover, the splicing must be multiplied by the number of lamps in a sign and the number (2) of lamp holders for each lamp.

However, it will be evident from the above description of Applicant's mounting apparatus, including the attachment bracket 40, the addition of the enlarged central hole 48 and the slots 49, that the lamp holders in Applicant's sign 10 may be inserted from the rear of the raceway cover 27. Accordingly, the wires connecting each lamp holder 31 and 32 may be pre-connected into an entire wiring harness which may be laid in the corresponding central channels 25 of the side frame members 14 and 15. The lamp holder may then be quickly latched in its attachment bracket 40 and the pre-assembled attachment bracket 40 and lamp holder 31 or 32 may then be inserted from the rear through the enlarged opening 48 in order to latch the latch tongues 52 within their corresponding slots 49. Such a procedure requires substantially less time than attempting to insert each lamp holder from the front and independently connect or splice the wires from each lamp holder to the rest of the wiring harness, and ultimately, to the electric power source.

Although the apparatus made in accordance with this invention may be utilized in a sign 10 having, for example, four lamps 30, such apparatus may be utilized for an illuminated sign utilizing fluorescent lamps 30 having any number or arrangement of lamps 30.

Moreover, this mounting apparatus permits the use of the existing conventional lamp holders 31 and 32, which may now be inserted from the rear of the raceway cover by only slight modifications to the raceway cover and also the addition of the attachment bracket 40 of unique construction.

As illustrated in FIGS. 1, 2, and 3, the wires 38 are initially connected together and inserted in the central channels 25 of the side frame members 14 and 15, and then lead through the central channel or any other channel in the bottom frame member 13 until the wires are connected to the ballast 60. Although not disclosed in the drawings, the ballast 60 is connected by electrical supply leads to a source of power in a conventional manner.

As disclosed in FIG. 1, the rear of the rectangular sign frame 11 is preferably covered by a transparent panel or cover 61, while the front of the rectangular sign frame 11 is covered by a front panel or cover, also of translucent or transparent material 62.

In the sign 10, either or both the translucent panel 62 are embossed or otherwise decorated with a plurality of letters or figures or other designs in a manner to present an illuminated sign of any desired configuration or design. The letters, not shown, in the panel 62 may be opaque, while the background area of the panel may be translucent, or vice versa, in order to transmit whatever illuminated image is desired.

What is claimed is:

1. A mounting apparatus for a fluorescent lamp holder having a body portion of non-circular cross-section and an enlarged head adapted to detachably receive one end of a fluorescent lamp, an electrical wire connected to said body portion, and a pair of spring clips on opposite sides of said body portion, comprising:

(a) a mounting plate having a front surface and a rear surface and a central hole therethrough larger than the largest cross-section of said lamp holder to permit the passage of said lamp holder through said central hole, (b) a pair of elongated slots extending through said mounting plate adjacent opposite sides of said central hole, (c) an attachment bracket comprising a plate member having front and rear surfaces and an attachment hole therethrough, said attachment hole having a non-circular shape of a size permitting insertion of the body portion of the lamp holder through said attachment hole from front-to-rear, the spring clips on said body portion being compressed by said attachment hole as said body portion is inserted through said attachment hole, said spring clips snapping outward behind and engaging said plate member when said body portion is fully inserted in said attachment bracket in a mounting position, (d) a pair of latch tongues projecting forward from said plate member spaced apart on opposite sides of said attachment hole, said latch tongues having the same spacing as said elongated slots and adapted to be received in said elongated slots as said attachment bracket is moved forward toward said mounting plate, each of said latch tongues having a retainer member engaging said rear surface of said mounting plate after said latch tongues are fully received in said slots in said mounting position, and (e) the head of said lamp holder projecting forward through said central hole in said mounting position.

2. The invention according to claim 1 in which the enlarged head of said fluorescent lamp holder is said largest cross-section of said lamp holder and said enlarged head has a greater cross-section than said non-circular shape of said attachment hole, said enlarged head engaging the front surface of said plate member when said spring clips engage the back surface of said plate member in said mounting position.

3. The invention according to claim 1 in which said pair of elongated slots are parallel, said pair of latch tongues also being parallel, said latch tongues having lengths each of which is slightly less than the length of said corresponding elongated slot, said slots being adapted to receive said corresponding latch tingues in said mounting position.

4. The invention according to claim 3 in which said plate member comprises a pair of opposed edge portions, each of said latch tongues projecting forward from a corresponding edge portion for extending through a corresponding slot in said mounting position, said retainer member of each of said latch tongues being formed on a corresponding latch tongue between said corresponding latch tongue and said attachment hole.

5. The invention according to claim 4 in which each of said latch tongues comprises an inside portion facing said impact hole, each of said retainer members being formed adjacent said inside portion of said corresponding latch tongue.

6. The invention according to claim 5 in which each of said latch tongues and said corresponding retainer members is formed of an integral piece including a latch tongue projecting forward from said corresponding edge of said plate member, the front edge portion of said latch tongue being bent back upon itself to form a planar retainer member having a free contact edge, said integral piece being made of a slightly elastic material in which said planar retainer member is biased to a latching position in which said free edge engages said front surface of said mounting plate in said mounting position, each of said planar retainer members being spaced inwardly from said corresponding latch tongue to extend over a portion of the front surface of said plate member in said mounting position.

7. The invention according to claim 6 in which each of said integral pieces including said latch tongue and said corresponding planar retainer member are sufficiently elastic that said retainer member is biased toward said corresponding latch tongue as said latch tongue and retainer member are forced through said corresponding slot to cause said free edge of each of said corresponding planar retainer members to snap inward over said rear surface of said plate member to cause said free edge of said planar retainer member to engage said front surface of said mounting plate in said mounting position whereby said attachment bracket may be fully assembled upon said mounting plate from the rear of said mounting plate in said mounting position.

8. The invention according to claim 1 in which said fluorescent lamp holder comprises a stationary fluorescent lamp holder, said attachment bracket comprising a first attachment bracket, and said mounting plate comprises a first raceway cover, and further comprising a compressible fluorescent lamp holder having an identical construction to said stationary fluorescent lamp holder, except said compressible lamp holder comprises a coil spring surrounding the body portion of said compressible lamp holder, a second raceway cover having a construction identical to said first raceway cover, a second attachment bracket having a construction identical to said first attachment bracket, said compressible lamp holder being mounted on said second attachment bracket for yielding axial movement relative to said second attachment bracket in said mounting position, a sign frame having opposed vertically extending side frame members, each of said side frame members comprising said corresponding first and second raceway covers.

9. The invention according to claim 8 in which each of said side frame members comprises a vertical side frame portion having an inside opening, each of said inside openings being closed by said corresponding first and second raceway covers, first wiring connected to said first lamp holder and second wiring connected to said second lamp holder, said first and second wiring being received within said vertical side frame portion adjacent said rear surface of said corresponding raceway cover.

10. The invention according to claim 9 in which said sign frame includes a horizontal bottom frame member supporting a ballast, said first and second wiring extending through said side frame members and through said bottom frame member and being connected to said ballast, and to a source of power.

11. The invention according to claim 10 further comprising a plurality of fluorescent lamps having opposed first and second contact ends, said first contact ends being adapted to be received in a corresponding stationary lamp holder, and each of said second contact ends being received in a compressible lamp holder.

* * * * *